US006609922B2

(12) United States Patent
Torii

(10) Patent No.: US 6,609,922 B2
(45) Date of Patent: Aug. 26, 2003

(54) CONNECTOR FOR SUBSTRATE

(75) Inventor: Chieko Torii, Shizuoka-ken (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/987,339

(22) Filed: Nov. 14, 2001

(65) Prior Publication Data

US 2002/0061671 A1 May 23, 2002

(30) Foreign Application Priority Data

Nov. 14, 2000 (JP) ..... P2000-347182

(51) Int. Cl.[7] ..... H01R 13/64
(52) U.S. Cl. ..... 439/247; 439/686
(58) Field of Search ..... 439/247, 248, 439/686, 852, 252, 246

(56) References Cited

U.S. PATENT DOCUMENTS 5,114,355 A * 5/1992 Kimmel et al. ..... 439/248

6,244,909 B1 * 6/2001 Okada et al. ..... 439/247

* cited by examiner

*Primary Examiner*—Javaid H. Nasri
(74) *Attorney, Agent, or Firm*—Finnegan, Henderson, Farabow, Garrett, & Dunner, L.L.P.

(57) ABSTRACT

A connector (19) includes a connector housing including a first housing (33); and a second housing (35) mated with the first housing (33). The first housing includes a first chamber (21); and a second chamber (37) communicating with the first chamber (21). The second chamber (37) has the second housing (35) inserted therein. The second housing includes a first wall (54) defining a channel (53). The connector includes a terminal (29) mounted into the connector housing. The terminal includes a contact part (25) accommodated in the first chamber (21) for electrically connecting with a mating terminal. The terminal includes a mounting part (27) extending outwardly from the second housing (35). The terminal includes a press-in part (79) between the contact part (25) and the mounting part (27). The press-in part (79) is pressed in the channel (53) against the first wall (54).

11 Claims, 10 Drawing Sheets

CONNECTOR FOR SUBSTRATE

BACKGROUND OF THE INVENTION

The present invention relates to a connector for a substrate connected directly to a substrate formed with a circuit for connecting substrates with each other.

A conventional connector for a base board includes a housing fixed to a base board; and terminals accommodated in the housing. The housing includes parts for fixation to the base board; and terminal accommodation chambers for the accommodation of the terminals. The parts for fixation are provided on both sides of the housing, with screws passing therethrough once fixed to the housing. In addition, the chambers have the terminals accommodated therein. The terminals have contact parts with mating terminals, provided to one end thereof. The terminals have parts for fixation provided to another end thereof, which pass through the base board and which are fixed to the reverse side of the base board, by soldering.

The connector has terminals accommodated in the chambers. Thereafter, the insertion of screws through the parts for fixation to be fixed to the base board by screwing allows the connector to be fixed to the base board. In this state, the connector and the mating connector to be connected, once fixed to the mating base board, are mated with each other, thus allowing electrical connection with the terminals of the mating connector.

In this case, the entering of lances into the locking openings of the chambers causes the terminals to be engaged for locking in the chambers. As a result, the looseness of the terminals in the chambers, resulting from the gaps between the openings and the lances and between the terminals and the chambers, allows the displacement relative to the mating connector to be absorbed.

SUMMARY OF THE INVENTION

Regarding the connector, however, when inserted in respective chambers are respective terminals, the openings of chambers and the lances of terminals correspond with each other, and the chambers accommodates the terminals. This mounting operation requires considerable time, thus resulting in high production costs.

In the connector, the alignment of terminals in the chambers with looseness causes the application of excessive force to the terminals, thus resulting in prizing and wearing.

The object of the invention is to provide a connector for a substrate wherein the mounting operation of a terminal to a terminal accommodation chamber is easily performed.

Another object of the invention is to provide a connector for a substrate wherein, during the mating with the mating connector, the absorption for displacement of the mating position prevents the application of excessive force to a terminal.

A first aspect of the invention is directed to a connector. The connector includes a connector housing (23) including a first housing (33); and a second housing (35) mated with the first housing. The first housing includes a first chamber (21); and a second chamber (37) communicating with the first chamber. The second chamber has the second housing inserted therein. The second housing includes a first wall (54) defining a channel (53). The connector includes a terminal (29) mounted into the connector housing. The terminal includes a contact part (25) accommodated in the first chamber for electrically connecting with a mating terminal. The terminal includes a mounting part (27) extending outwardly from the second housing. The terminal includes a press-in part (78, 79) between the contact part and the mounting part. The press-in part is pressed in the channel against the first wall.

Preferably, the press-in part includes a base (78) loosely fitted in the channel. The press-in part includes a bulge (99) extending from the base.

Preferably, the contact part includes a resilient member (85) bent back for contacting the mating terminal.

Preferably, the resilient member includes a base end. The base end includes a curved first guide (75) to be slid on the first housing.

Preferably, the bulge includes a second guide (103, 105) extending obliquely from the base for sliding on the first wall and for guiding the press-in part in the channel.

Preferably, the second housing includes a second wall (151) adjacent to the first wall at an end thereof. The second wall has the press-in part passing therethrough. The second wall has the second guide fitted therein.

Preferably, the press-in part includes an absorption part (77) projecting therefrom for absorbing stress.

Preferably, the first housing includes a third wall defining the first chamber. The third wall has an opening (39) therethrough.

Preferably, the second housing includes a fourth wall (57) projecting from the channel for retaining the base together with the first housing.

A second aspect of the invention is directed to a connector for a substrate. The connector includes a connector housing (23) including accommodation chambers (21) therein. The connector includes terminals (29). The terminals include contact parts (25) accommodated in the accommodation chambers for connecting to the mating terminals. The terminals include solder parts (27) to be soldered to a substrate (3). The connector housing includes a first housing (33). The first housing includes a mounting opening (37) formed at an end thereof for drawing out the solder parts. The first housing includes insertion openings (39) provided at another end thereof for inserting the terminals in the accommodation chambers. The connector housing includes a second housing (35) mounted into the mounting opening for retaining intermediate parts (78) between the contact parts and the solder parts together with inner walls of the accommodation chambers. The second housing has accommodation channels (53) on both sides for accommodating the intermediate parts. The terminals include press-in parts (79) pressed in the accommodation channels.

Preferably, the terminals includes guides (75) formed at ends of the contact parts for sliding on the first housing and for guiding the contact parts in the accommodation chambers when the terminals are mounted into the accommodation chambers of the first housing.

Preferably, the contact parts include contact part bodies (81) extending longitudinally from the terminals. The contact parts include contact members (85) connected to the contact part bodies, using curved parts (83), for contacting resiliently the mating terminals. The guides includes outer peripheral faces of the curved parts.

BRIEF DESCRIPTION OF THE ACCOMPANYING DRAWINGS

DETAILED DESCRIPTION OF THE PREFERRED EMBODIMENTS

Figure 1:
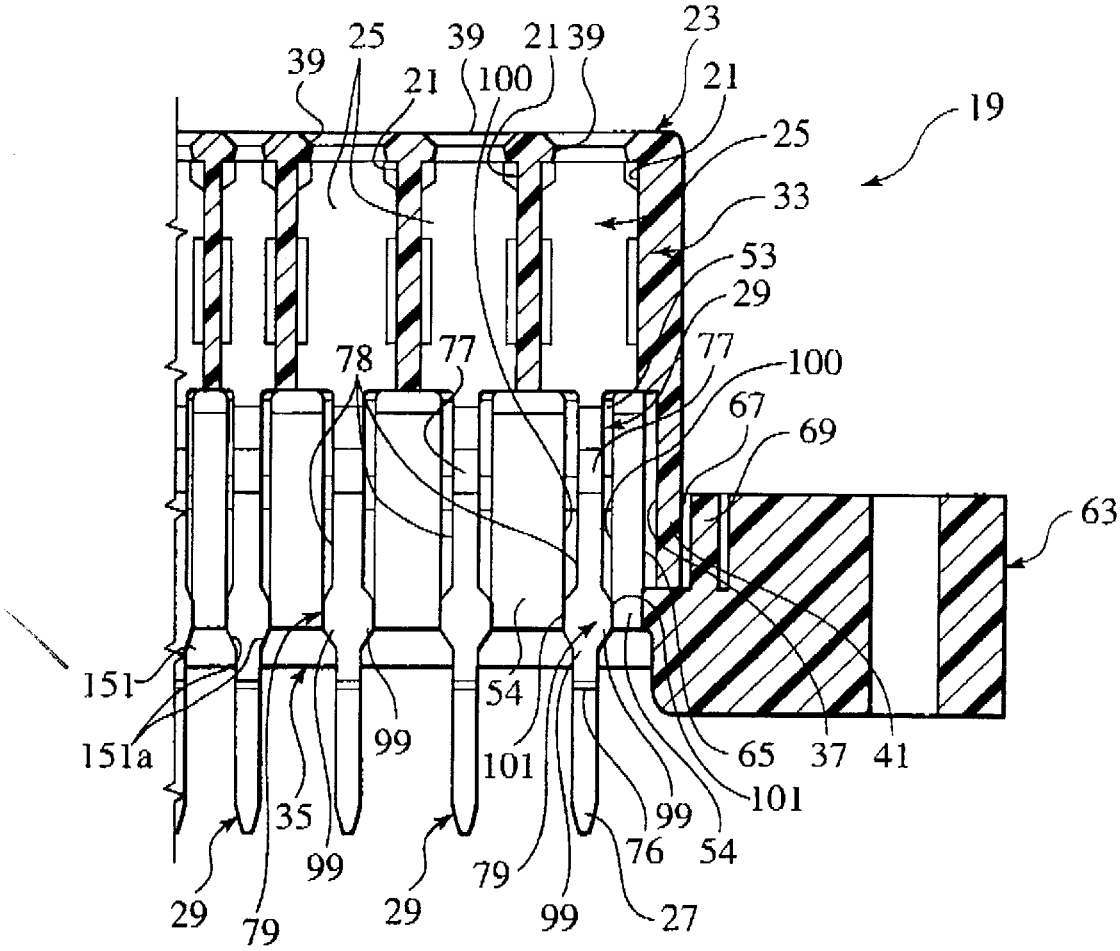
FIG. 1 is a sectional view showing the first embodiment of the connector for a base board according to the invention.

Hereinafter, the first embodiment of the invention will be explained with reference to drawings.

As shown in FIGS. 1 to 6, connector 19 for a base board includes housing 23 formed with terminal accommodation chambers 21. Connector 19 includes terminals 29 provided with: contact parts 25 accommodated in chambers 21 for connection with the mating terminals; and fixation parts 27 to be soldered to base board 3. Connector 19 is mounted directly on base board 3.

Figure 2:
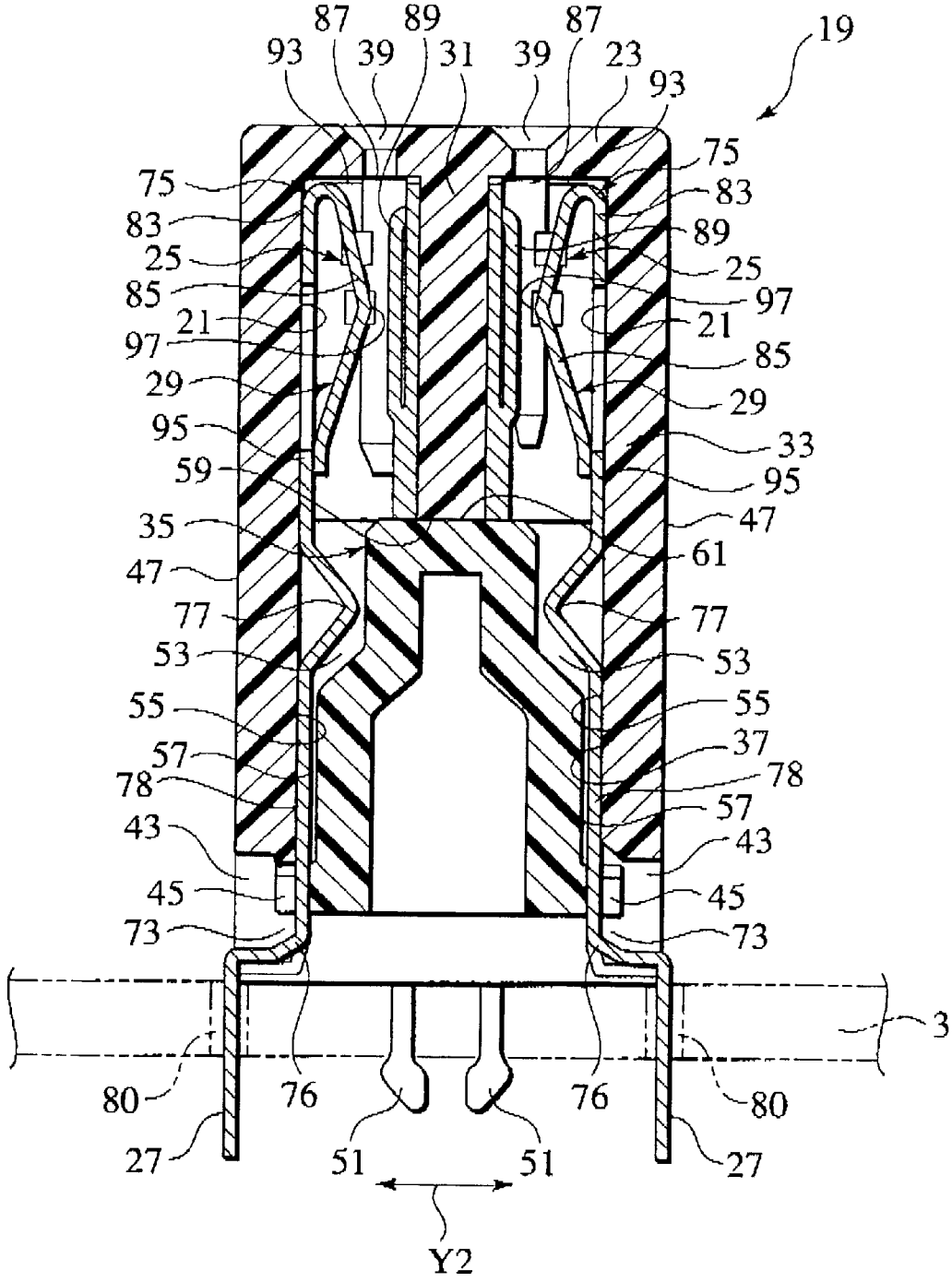
FIG. 2 is a sectional view of the connector as shown in FIG. 1, taken along a transverse direction thereof.
Figure 3:
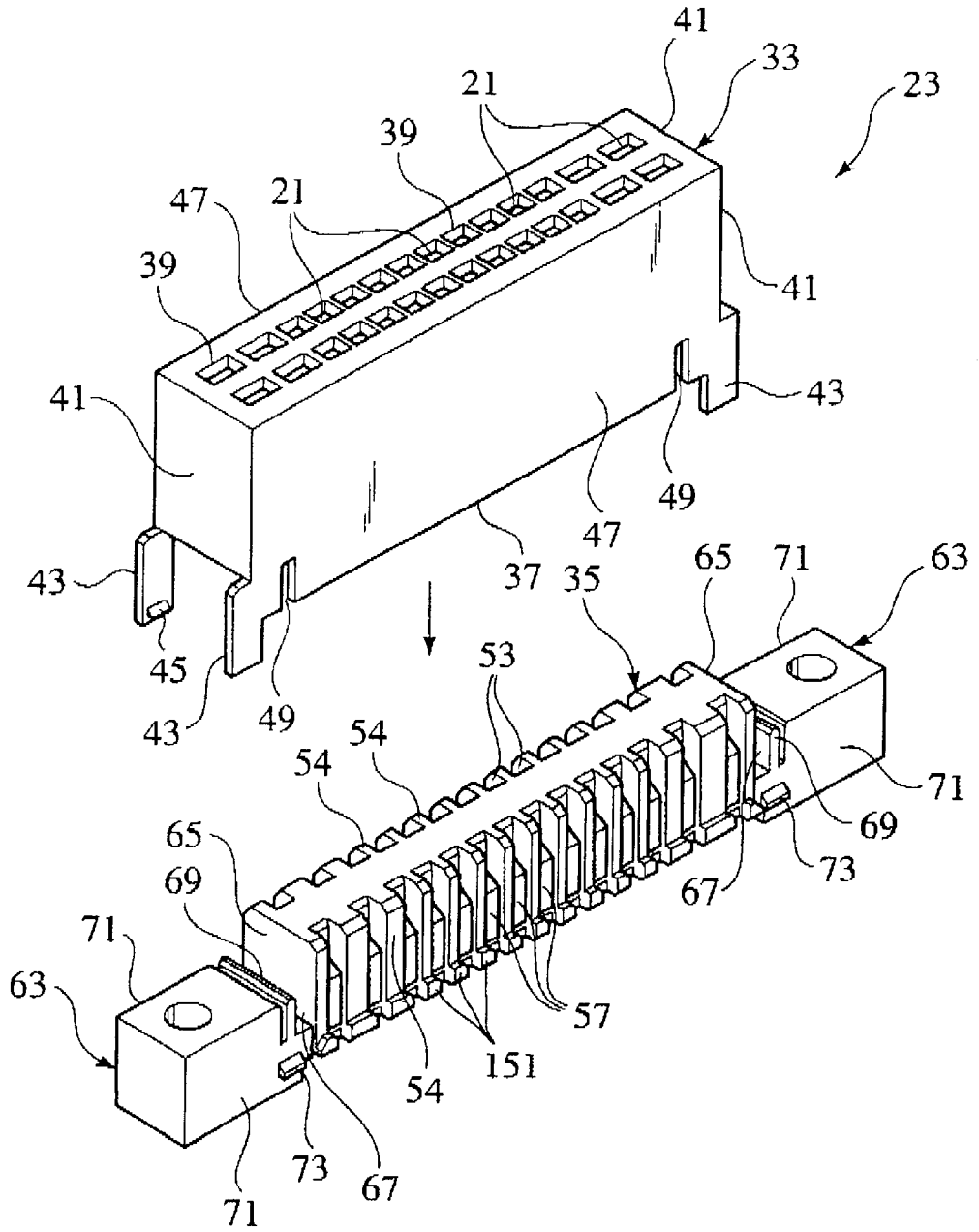
FIG. 3 is an exploded perspective view of the connector as shown in FIG. 1.

Housing 23, as shown in FIGS. 1 and 2, has outer housing 33 where inner partition 31 separates chambers 21 into double steps. Housing 23 includes outer housing 33; and inner housing 35 mounted to outer housing 33. The end of outer housing 33, as shown in FIGS. 1 to 3, includes mounting opening 37 to allow the extension of soldering fixation parts 27 outwardly. Another end thereof includes insertion openings 39 for the insertion of the mating terminals, to be connected to terminals 29, in chambers 21. Inserted from opening 37 of outer housing 33 is inner housing 35.

Figure 4:
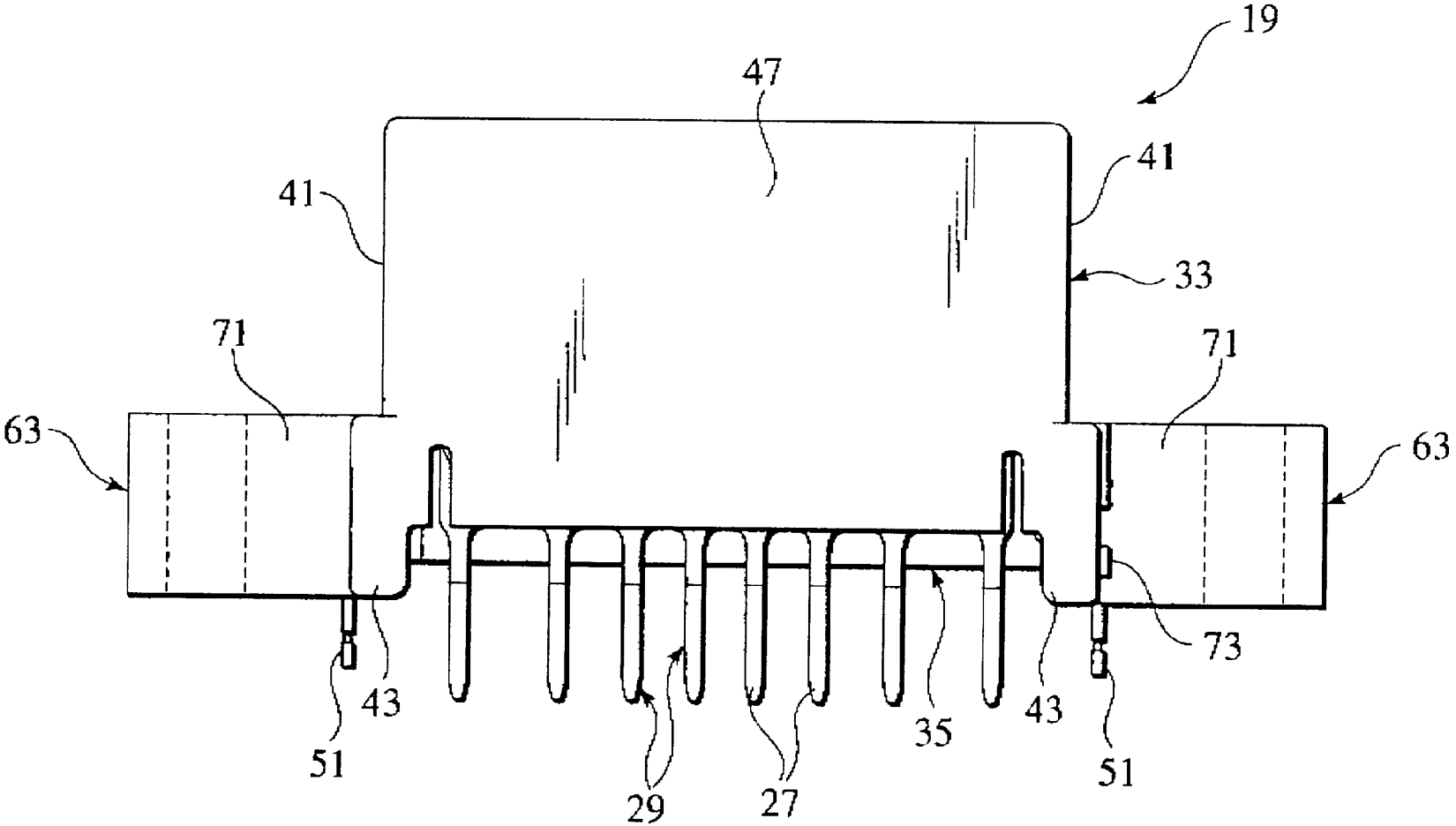
FIG. 4 is a side view of the connector as shown in FIG. 1.

Provided at the bottoms of both longitudinal sides 41 of outer housing 33, as shown in FIGS. 2 and 3, are pairs of flexible locking arms 43 facing each other, respectively. Provided on the respective facing sides of the end of arms 43 are respective locking projections 45. In addition, formed on both transverse sides of outer housing 33, as shown in FIG. 3, are slots 49 adjacent to arms 43, respectively. Projecting from the bottom side of inner housing 35, as shown in FIGS. 2 and 4, are projections 51 for the provisional fixing to base board 3.

On the other hand, provided on both sides of the rectangular parallelepiped inner housing 35, as shown in FIG. 3, are terminal accommodation channels 53 for the accommodation of terminals 29. Adjacent channels 53 are separated by partitions 54, respectively. Channels 53, as shown in FIG. 2, with terminals 29 accommodated on the bottom sides inside thereof, include terminal retaining faces or projections 57 which project from the bottoms thereof for retaining of terminals 29 between inner walls 55 of chambers 21 and retaining faces 57 respectively. Provided on the top side is contact part 61 contacting lower end 59 of inner wall 31. The contact between the lower end of inner wall 31 and contact part 61 allows the insertion position of inner housing 35 relative to the inside of outer housing 33 to be determined.

Figure 5:
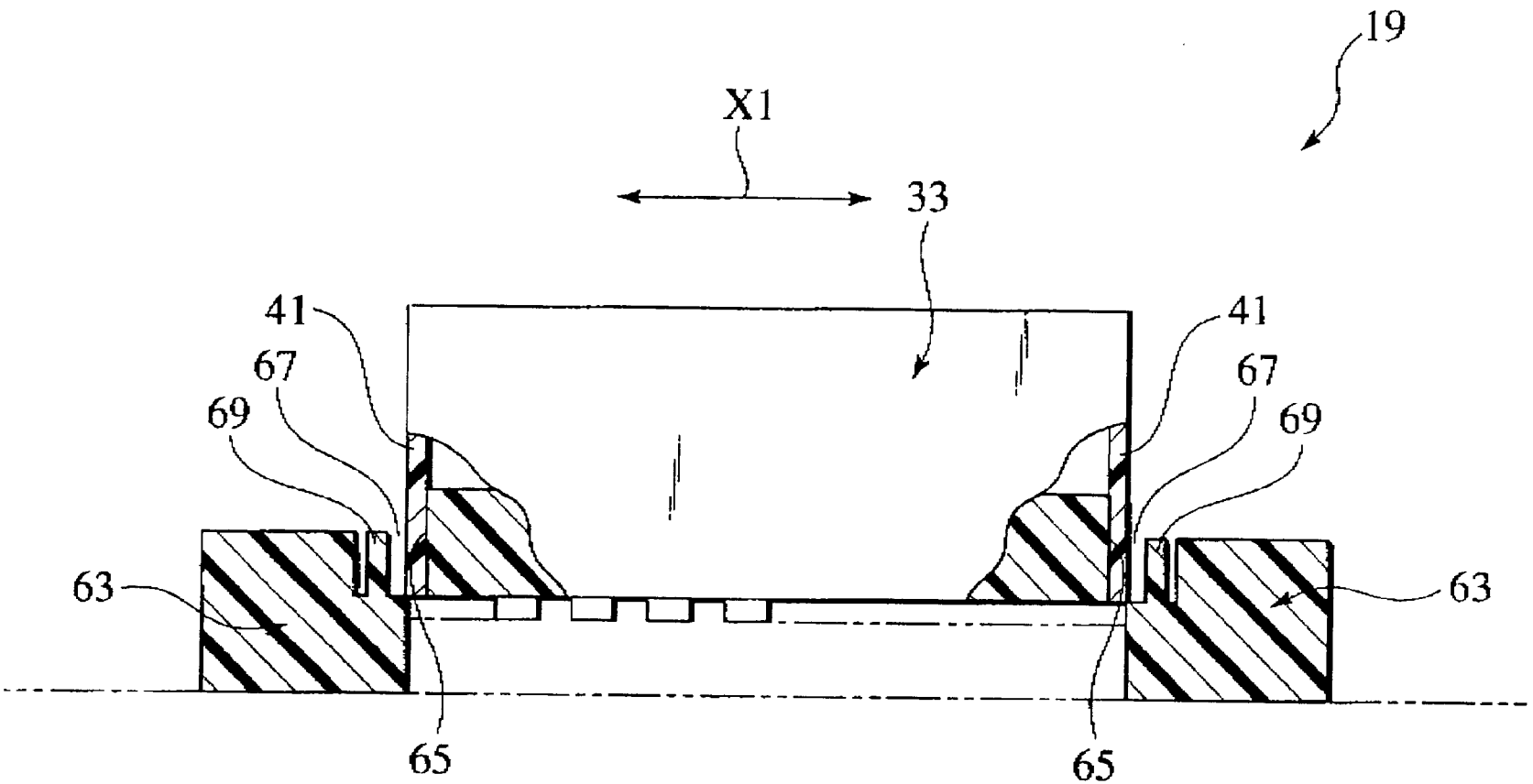
FIG. 5 is a partially broken-away sectional view of the connector as shown in FIG. 4.
Figure 6:
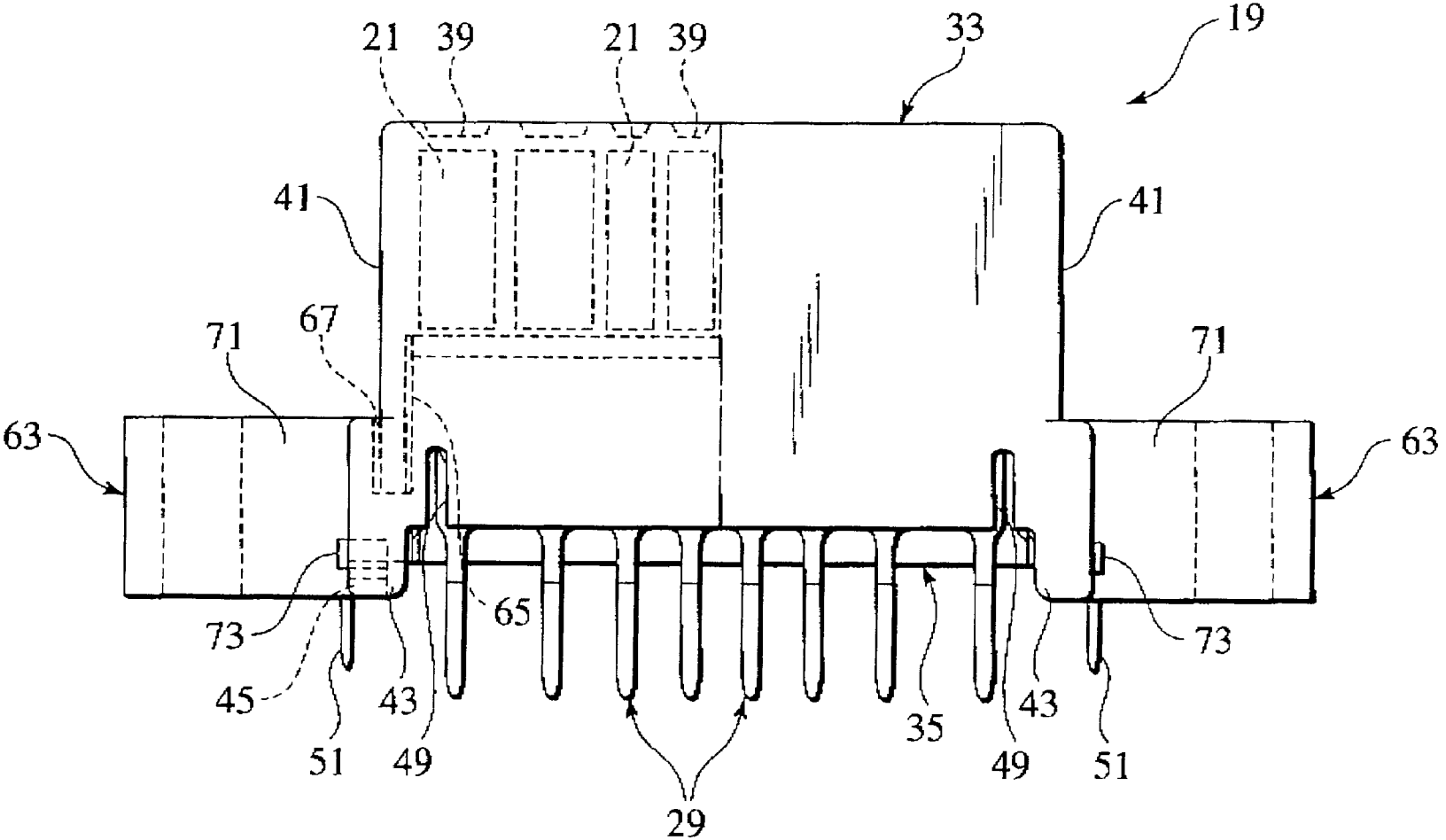
FIG. 6 is a side view showing the inside of the connector as shown in FIG. 4 with a chain line.

Formed integrally at the both longitudinal sides of inner housing 35, as shown in FIGS. 3 and 6, are fixation parts 63 relative to base board 3. Defined between fixation parts 63 and both sides 65 of inner housing 35, are gaps 67, respectively. Inserted in gaps 67, as shown in FIGS. 1 and 5, are both sides 41 of outer housing 33. Between fixation parts 63 and both longitudinal sides 65 of inner housings 35, flexible plates 69 are formed integrally to fixation parts 63, respectively. Flexible plates 69 and both sides 65 support both sides 41 therebetween, respectively. Flexible plates 69 allows outer housing 33 to be moved relation to fixation parts 63 (the direction indicated by arrow X1 in FIG. 5).

In addition, fixation parts 63, as shown in FIG. 3, have lock projections 73 provided on both sides 73 thereof in a perpendicular direction (the direction indicated by arrow Y2 in FIG. 2) relative to the direction of the movement of outer housing 33 with fixation parts 63. The projections 73 are engaged with projections 45 of outer housing 33 to retain outer housing 33 to inner housing 35. At this time, flexible arms 43 allow outer housing 33 to be moved in a perpendicular direction (the direction of arrow Y2) relative to the direction of the movement with fixation parts 63 (the direction of arrow X1). Even when one side 41 is brought in contact with flexible plate 69, the flexing of plate 69 allows the movement of outer housing 33 with fixation parts 63.

Figure 7:
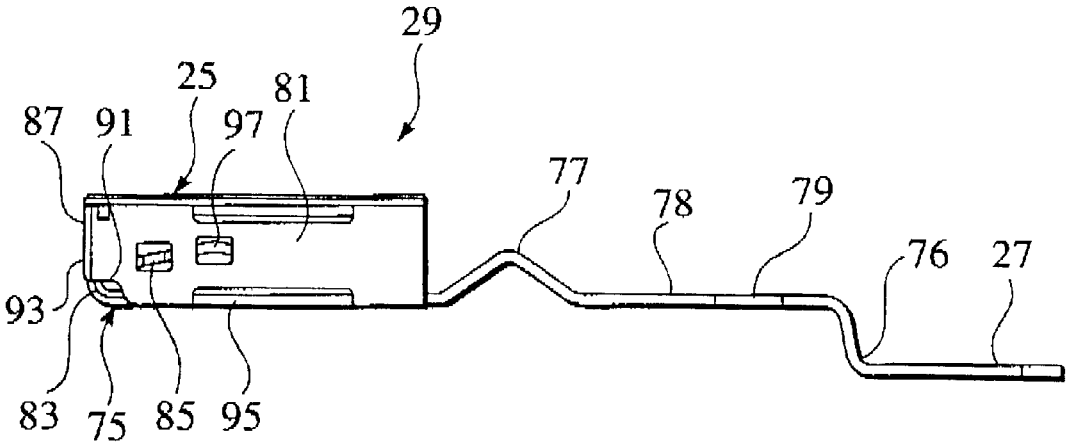
FIG. 7 is a side view of a terminal of the terminal as shown in FIG. 1.
Figure 8:
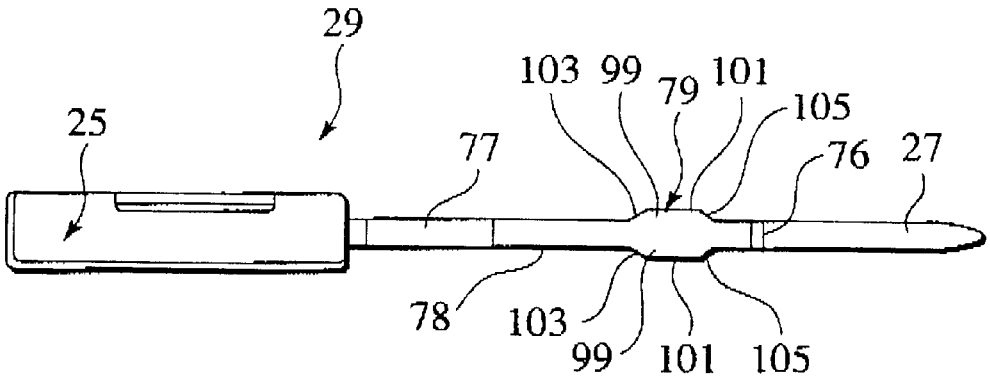
FIG. 8 is a plane view of the terminal shown in FIG. 7.

The housing 23 has terminals 29 accommodated in chambers 21. An end of each terminal 29, as shown in FIGS. 7 and 8, has contact part 25 with the mating terminal. Another end thereof includes fixation part 27 which passes through base board 3 and to be fixed on the reverse side of the board by soldering. Terminal 29 has sliding guide part 75 provided at the end of contact part 25. In addition, contact part 25 and fixation part 27 have bent part 76 bent in a crank-shape, formed therebetween. Bent part 76 and contact part 25 have stress absorption part 77 bent in a V-shape, formed therebetween. Absorption part 77 and bent part 76 have press-in fixation part 79 to fix terminal 29 to inner housing 35, provided therebetween. The portions 78 between absorption parts 77 and bent parts 76 of terminal 29, as shown in FIG. 1, are accommodated in channels 53.

Contact part 25, as shown in FIG. 7, includes tubular part 81 extending longitudinally of terminal 29. The contact part includes contact piece 85 connected via curved part 83 to the inside of tubular part 81. Tubular part 81 is configured as an elongated and hollow tube. As shown in FIG. 2, the introduction of the mating terminals inside thereof from openings 87 at the end of contact parts 25, allows later-described contact pieces 85 and side walls 89 to retain the mating terminals therebetween. The end of tubular part 81, as shown in FIG. 7, has cut-out portion 91 provided thereto.

Cut-out portion 91 is cut out from end face 93 of the tip end of tubular part 81 and the outer side of another side wall 95 facing one transverse side wall 89. A corner of the tip end of tubular part 81 is cut off. This tubular part 81 has contact piece 85 accommodated therein.

Resilient contact piece 85, as described above, connects to tubular part 81 via curved part 83 as described later. Contact piece 85, as shown in FIGS. 2 and 7, is constituted with a plate member, being bent at intermediate part 97 as a fulcrum. Intermediate part 97 of contact part 85 resiliently contacts with the mating terminal introduced from opening 87 to the inside.

Curved part 83 interconnecting between contact piece 85 and tubular part 81 is configured as a curved plate with resilience. One end of curved part 83 is formed integrally to the end face located in cut-out 91 of another side wall 95 of tubular part 81. Another end thereof is located inside of tubular part 81, being integral to contact piece 85. The portion between the one end and the other end of curved part 83 projects or is exposed from cut-out 91 to the outside of tubular part 81.

The sliding guide part 75 includes the outer periphery face of the portion projecting from cut-out 91 of curved part to the outside of tubular part 81. Guide part 75 is formed with a curved face at the corner of the tip end of contact part 25.

Terminal 29 has the above-described press-in fixation part 79 provided thereto. Fixation part 79, as shown in FIG. 8, includes a pair of plate parts 99 between stress absorption part 77 and bent part 76 of terminal 29.

Plate parts 99, as a bulge, extend and project outwardly from the both transverse sides of terminal 29. One transverse side of plate parts 99 serves as a fixation end formed integrally to terminal 29. The other end serves as a free end located transversely outside of terminal 29. A pair of plate parts 99, as shown in FIG. 1, have the dimension between end faces 101 formed to the free ends, which is substantially identical to or slightly larger than between the faced inner sides 100 of adjacent partitions 54 of channels 55. When channel 53 accommodates terminal 29, the end faces 101 of plate parts 99 contact with the inner sides 100 of adjacent partitions 54 of channels 53 respectively, pressing terminal 29 in channel 53, and allowing terminal 29 to be fixed in channel 53. Both longitudinal sides of plate parts 99, as shown in FIG. 8, include obliques 103 and 105 extending from the free ends to the base ends, respectively.

One oblique 103 is located at one side of terminal 29, extending from the one side toward the other side of terminal 29 and gradually from the fixation end toward the free end, thus contacting end face 101 at the free end of plate part 99. This oblique 103 is continuous with the other oblique 105 via end face 101.

The other oblique 105 is located to the other side of terminal 29. The oblique of terminal 29 extends inverse from the one side toward the other side and gradually from the fixation end (proximal end) to the free end (distal end). The oblique contacts end face 101 at the free end of plate part 99. Obliques 105 guide plate parts 99 in channel 53 when channels 55 accommodate terminals, respectively.

Figure 9:
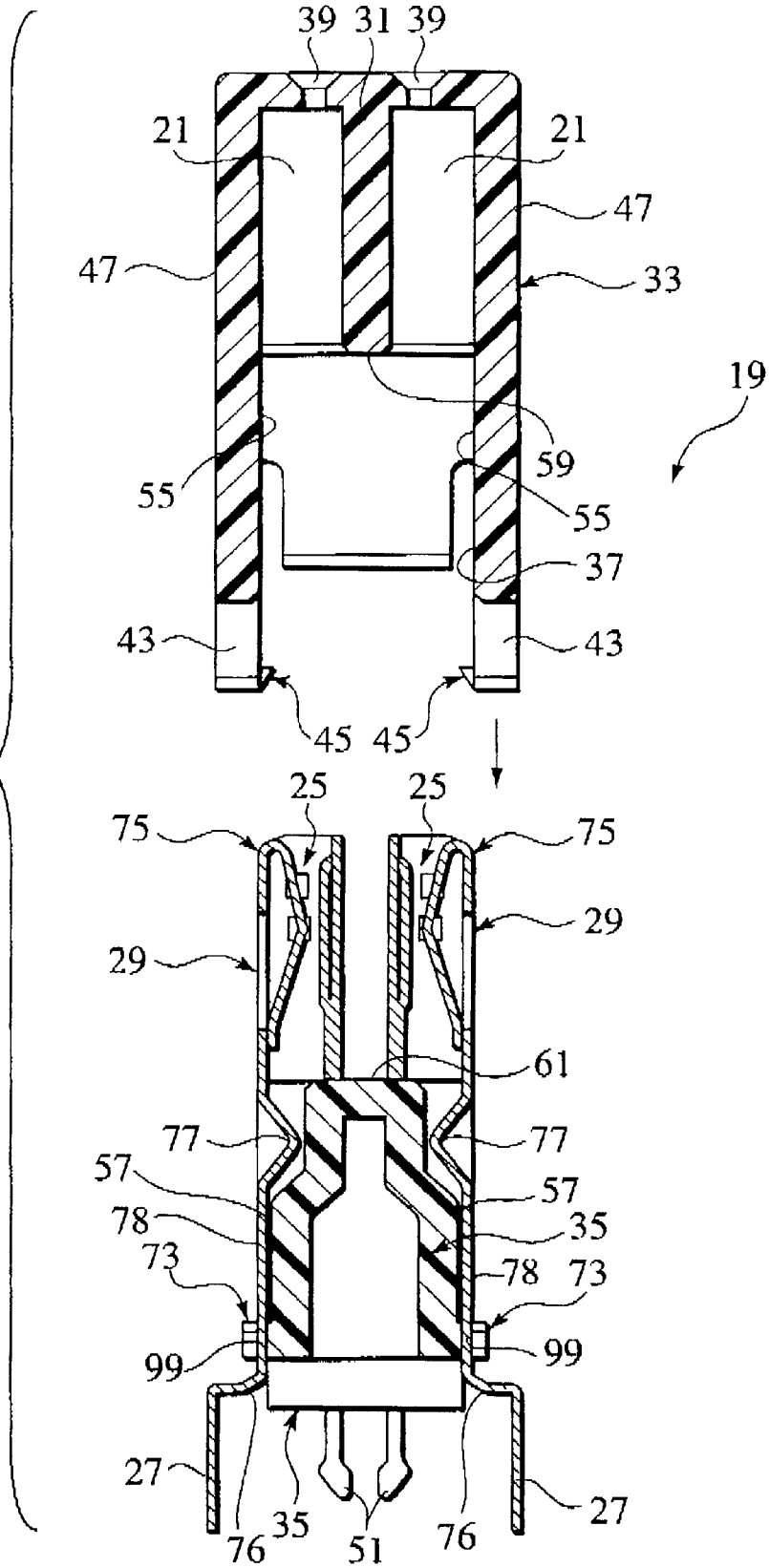
FIG. 9 is a sectional view of the connector as shown in FIG. 1 during the mounting.

When the connector is mounted, firstly, as shown in FIG. 9, channels 53 of inner housing 35 accommodate the portions 78 between stress absorption parts 77 and bent parts 76, thus preliminarily mounting terminal 29 to inner housing 35. Next, the insertion of inner housing 35 mounted with terminal 29 into opening 37 of outer housing 33, causes inner housing 35 and outer housing 33 to be mounted to each other.

When terminals 29 are accommodated in channels 53, terminals 29, as not shown in Figs., are located at the upper parts of channels 53 for the correspondence of the fixation parts 79 of terminals 29 with the upper openings of channels 53. In this state, terminals 29 are moved toward channels 53 to be inserted.

The insertion of terminals 29 into channels 53 causes the other obliques 103 of plate parts 99 to be contacted with the top faces of partitions 54 adjacent to channels 53, respectively. When terminals 29 are pressed toward channels 53, obliques 103 slide along the top faces for guiding plate parts 99 in channels 531. At this time, end faces 101 of plate parts 99 contact and slide against facing inner sides 100 of adjacent partitions 54 of channels 53, thus being pressed into channels 53.

With further pressing of terminals 29 toward channels 53, plate parts 99 are pressed to regular position in channels 53 and fixation parts 79 of terminals 29 are fixed in channels 53 for accommodation. Obliques 105 of fixation parts 79 fit between tapered faces 151*a* defined by the inner sides of end walls 151.

The repetition of the operation of accommodating the above-described terminal 29 in channel 53 results in the accommodation of terminals 29 in channels 53, respectively. Inner housing 35, preliminary mounted with terminals 29, is mounted to outer housing 33.

When inner housing 35 is mounted to outer housing 33, as shown in FIG. 9, opening 37 of outer housing 33 corresponds with inner housing 35. Thereafter, inner housing 35 is inserted into outer housing 33 for mounting.

The insertion of inner housing 35 into outer housing 33 causes the ends of contact parts 25 of terminals 29 to enter into chambers 21 of outer housing 33. At this time, even when the ends of contact parts 25 contact the inner peripheral face of outer housing 33, the sliding of guide parts 75 on the inner peripheral face causes the reliable guidance of contact parts 25 by the curvature of chambers 21.

When inner housing 35 is further inserted in outer housing 33, contact parts 25 of terminals 29 are accommodated together in chambers 21. The lower end 59 of inner partition 31 of outer housing 33 contacts with contact part 61, thus determining the insertion position of inner housing 35 relative to outer housing 33. As a result, outer housing 33 and inner housing 35 are mounted to each other.

As shown in FIG. 2, with terminal 29 and inner housing 35 being mounted to outer housing 33, the portions between contact parts 25 and fixation parts 27 of terminals 29 are retained between inner walls 55 and retaining faces 57, resulting in the double locking of terminals 29 to housing 23. The fixation parts 27, extending from opening 37 of outer housing 33, each are inserted through hole 80 of base board 3 for fixing to the reverse side of base board 3 by soldering. In addition, as shown in FIGS. 1 and 5, the insertion of both sides 41 of outer housing 33 into gaps 67 allows the insertion between flexible plates 69 and sides 65 of inner housing 35, thus resulting in the connection of inner housing 35 and outer housing 33 to each other. Arms 43 retain fixation parts 63 therebetween, and projections 45 engage with projections 73. Thereafter, connector 19 is mated with the mating connector for the electrical connection of the terminals 29 and the mating terminals with each other.

Figure 10:
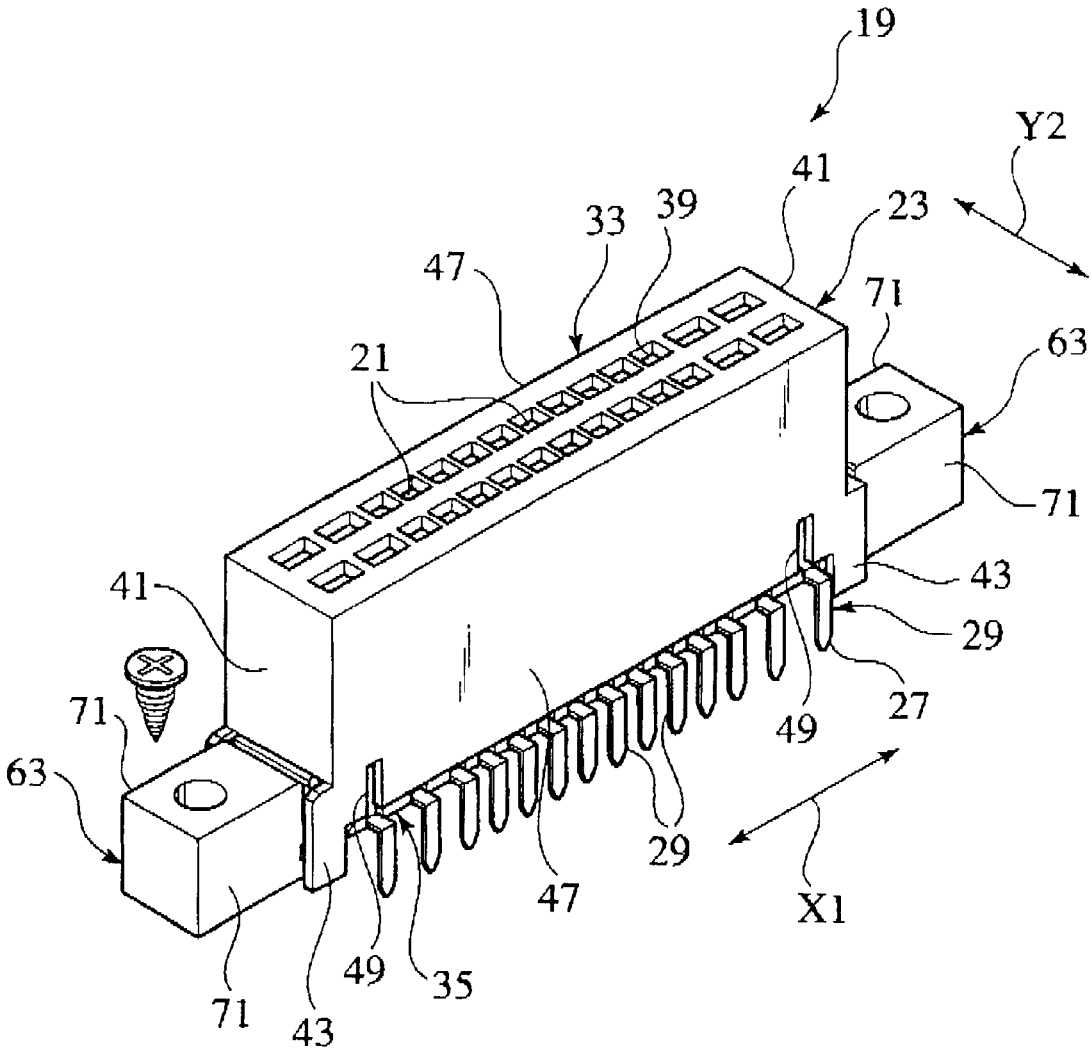
FIG. 10 is a perspective view showing the mounted connector as shown in FIG. 9.

When connector 19 is mated with the mating connector, openings 39 of outer housing 33 correspond with the terminals of the mating connector. At this time, even when the mating terminal is displaced from the regular mating position, outer housing 33, as shown in FIG. 10, is movable in all directions (including X1 and Y2 directions) relative to inner housing 35. Thus, the movement of outer housing 33 toward the displaced mating connector allows openings 39 and the terminals of mating connector to reliably correspond with each other.

Next, with openings 39 of accommodation 39 and the mating terminal in correspondence with each other, connector 19 and the mating connector are mated with each other.

The mating of connector 19 with the mating connector allows the terminals of the mating connector to be inserted into chambers 21 from openings 39 of outer housing 33 and to be introduced from openings 87 of terminals 29 into contact parts 25. At this time, force in the mating direction (force normal to base board 3), applied to terminals 29, does not exert directly on fixation parts 27 due to the fixing of the terminals 29 to channels by the absorption parts 77 and fixation parts 79.

In addition, even when force is applied to terminals 29 along the side of base board 3, the fixing of fixation parts 79 of terminals 29 to channels 53 allows the force to be absorbed. Thus, the force does not exert directly on fixation parts 27.

Figure 11:
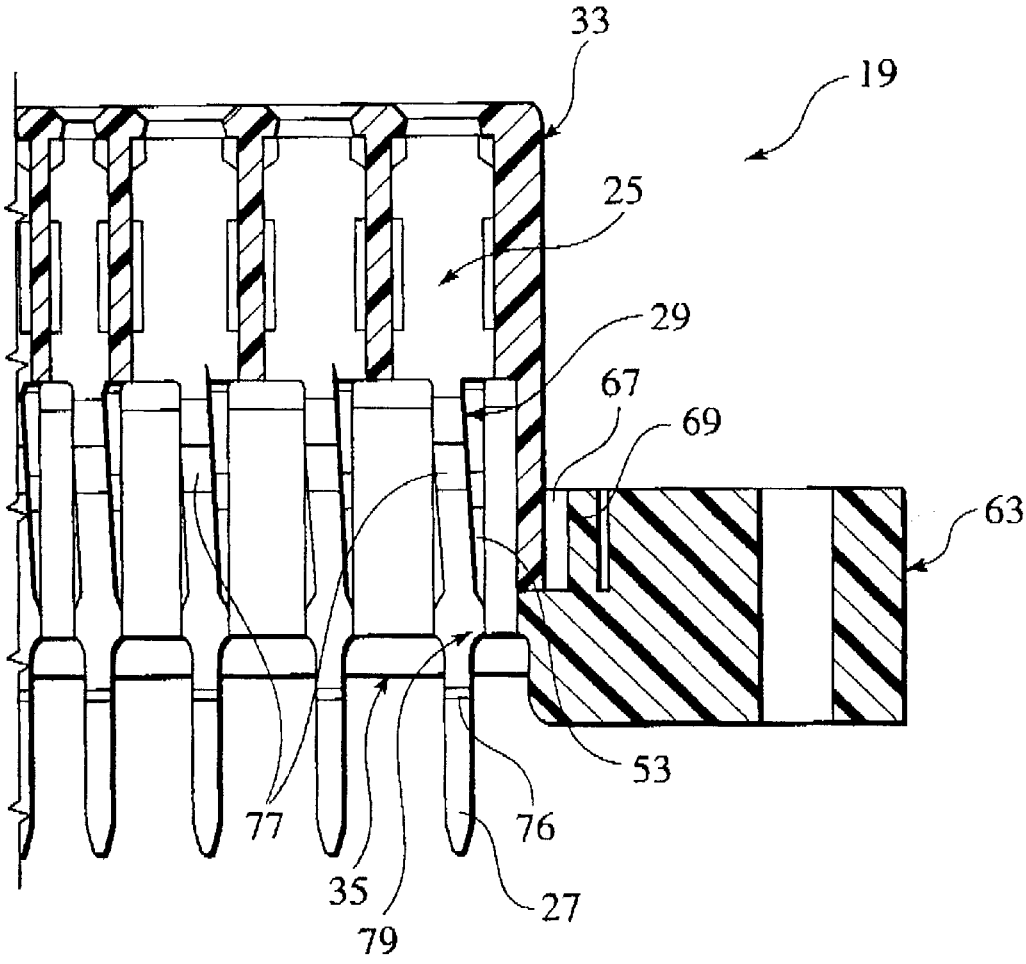
FIG. 11 is a sectional view showing the motion of the terminal as shown in FIG. 1.

If connector 19 and the mating connector are mated with each other, even when the mating connector is displaced from the regular mating position, as shown in FIG. 11, the mating of connector 19 with the mating connector (not shown) causes the introduction of the terminals (not shown) of the mating connector into contact parts 25. This causes contact parts 25 to be displaced toward the terminals of the mating connector about the fixed points of fixation parts 79 to channels 53 due to the resilience of terminals 29 for the absorption of displacement.

When connector 19 and the mating connector are completely mated with each other, contact pieces 85 of contact parts 25 contact due to the resilience of curved parts 83, retaining the mating terminals together with a wall 89 of tubular part 81.

In connector 19 of the embodiment, fixation parts 79 are pressed in channels 53 for the preliminary fixing of terminals 29 to inner housing 35. This allows the mounting of inner housing 35 to outer housing 33 and the accommodation of terminals 29 in chambers 21 of outer housing 33. This, in connector 19, allows the operation steps for the alignment of terminals 29 with chambers 21 to be reduced and terminals 29 to be easily mounted into chambers 21, thus reducing production costs.

In connector 19, contact parts 25 are displaceable about the fixed points of fixation parts 79 to channels 53 due to resilience of terminal 29. When the mating terminals displaced from the regular mating position are mated, the introduction of the mating terminals into contact parts 25 causes contact parts 25 to be displaced toward the mating terminals and to be in alignment. This easily allows the mating connector to be displaced from the regular mating position. Without the need of applying excessive force to terminal 29, the reliable electrical connection with the mating terminals is performed.

In addition, in the embodiment, when careless force is applied to contact parts 25, looseness of contact parts 25 about the fixed parts of fixation parts 79 and channels 53 is generated, and the force does not exert directly on fixation parts 27. Thus, at the portions where fixation parts 27 are soldered to base board 3, damage such as cracks are reliably prevented.

In connector 19, fixation parts 79 of terminals 29 are pressed in channels 53 for fixing, and the portions between contact parts 25 and fixation parts 27 are retained between inner wall 55 and retaining faces 57. This causes terminals 29 to be double locked to housing 23. This allows terminals 29 to be reliably fixed to housing 23.

In the embodiment, when contact parts 25 contact with the inner peripheral face of outer housing 33, guide parts 75 slide on the inner peripheral face for guiding contact parts 25 into chambers 21. Without the conventional insertion of terminal 29 into chamber 21 with attention to the correspondence of contact parts 25 with chambers 21, the damage of terminals 29 is prevented, allowing terminals 29 to be reliably accommodated in chambers 21. This, in connector 19, improves the operability of the inserting of terminals 29 into chambers 21, allowing reduction in production costs.

In connector 19, the forming of guide parts 75, using the curved parts of contact parts 25, allows the easy guidance of terminals 29 into chambers 21 at low production costs.

In addition, in the connector of the embodiment, both sides of outer housing 33 are supported by flexible plates 69. Projections 45, engaged with projections 73, are provided to flexible arms 43.

Thus, the engagement of projections 45 of arms 43 with projections 73 of fixation parts 63 allows outer housing 33 to be moved relative to inner housing 35, with outer housing 33 and inner housing 35 integrally retained. Thus, the terminals of the mating connector displaced from the regular position correspond with openings 39 to be aligned, thus allowing reliable mating with the mating connector. The mating connector is mated, without the application of excessive force to terminal 29, preventing prizing and wearing.

As described above, pressing of terminals in channels causes the terminals to be preliminarily fixed to an inner housing. In this state, the mounting of the inner housing to an outer housing allows the terminals to be accommodated together in chambers. This allows the terminals to be easily mounted to the chambers, thus reducing the production costs of the connector.

Contact parts are displaceable about fixed points of the fixation parts and the channels due to resilience of the terminals. The contact parts allow the terminals of the mating connector to be displaced from a regular mating position. Without the application of excessive force to the terminal, this enables the reliable electrical connection with the mating terminal.

During the mounting of the terminals to the outer housing, even when the ends of contact parts contact the outer housing, the sliding of guide parts on the outer housing causes the guiding of the contact parts in terminal accommodation chambers. Thus, without the accommodation of the terminals in the chambers with the attention to the positions between the terminals and the chambers, the terminals are easily accommodated in the chambers, and the longitudinal deformation of the terminals is prevented.

During the mounting of the terminal to the outer housing, even when the ends of the contact parts contact the outer housing, the outer peripheral faces of curved parts are slid on the outer housing for guiding the contact parts into the chambers. Thus, without the accommodation of the terminals in the chambers with the attention to the positions between the terminals and the chambers, the terminals are easily accommodated in the chambers and the longitudinal deformation of the terminals is prevented.

The formation of the guide parts, using the curved parts of the contact parts allows the terminals to be easily guided into the chambers at a low production cost.

The entire content of Japanese Patent Applications P2000-347182(filed Nov. 14, 2000) is incorporated herein by reference.

Although the invention has been described above by reference to certain embodiments of the invention, the invention is not limited to the embodiments described above. Modifications and variations of the embodiments described above will occur to those skilled in the art, in light of the above teachings. The scope of the invention is defined with reference to the following claims.

What is claimed is:

1. A connector comprising:

a connector housing including a first housing; and a second housing mated with the first housing, the first housing including a first chamber; and a second chamber communicating with the first chamber, the second chamber having the second housing inserted therein, the second housing including a first wall defining a channel; and a terminal mounted into the connector housing, the terminal including:

a contact part accommodated in the first chamber for electrically connecting with a mating terminal;

a mounting part extending outwardly from the second housing; and a press-in part between the contact part and the mounting part and within the channel, the press-in part comprising a base loosely fitted into the channel; and a bulge extending from the base for pressing against the first wall.

2. The connector according to claim 1, wherein the second housing comprises: a fourth wall projecting from the channel for retaining the base together with the first housing.

3. The connector according to claim 1, wherein the contact part comprises:

a resilient member bent back for contacting the mating terminal.

4. The connector according to claim 3, wherein the resilient member including a base end, the base end comprising a curved first guide to be slid on the first housing.

5. The connector according to according to claim 1, wherein the bulge comprises:

a second guide extending obliquely from the base for sliding on the first wall and for guiding the press-in part in the channel.

6. The connector according to claim 5, wherein the second housing comprises: a second wall adjacent to the first wall at an end thereof, the second wall having the press-in part passing therethrough, the second wall having the second guide fitted therein.

7. The connector according to claim 1, wherein the press-in part comprises: an absorption part projecting therefrom for absorbing stress.

8. The connector according to claim 1, wherein the first housing comprises: a third wall defining the first chamber, the third wall having an opening therethrough.

9. A connector for a substrate comprising:

a connector housing including accommodation chambers therein; and terminals comprising:

contact parts accommodated in the accommodation chambers for connecting to mating terminals; and solder parts to be soldered to a substrate, wherein the connector housing comprises:

a first housing including:

a mounting opening formed at an end thereof for drawing out the solder parts; and insertion openings provided at another end thereof for inserting the terminals in the accommodation chambers; and a second housing mounted into the mounting opening for retaining intermediate parts between the contact parts and the solder parts together with inner walls of the accommodation chambers, wherein the second housing have channel walls defining accommodation channels on both sides for accommodating the intermediate parts, wherein the terminals comprise press-in parts in the accommodation channels, wherein the press-in parts comprise bases loosely fitted in the accommodation channels; and bulges extending from the bases for pressing against the channel walls.

10. The connector according to claim 9, wherein the terminals comprise: guides formed at ends of the contact parts for sliding on the first housing and for guiding the contact parts in the accommodation chambers when the terminals are mounted into the accommodation chambers of the first housing.

11. The connector according to claims 10, wherein the contact parts comprise:

contact part bodies extending longitudinally from the terminals; and contact members connected to the contact part bodies, using curved parts, for contacting resiliently the mating terminals, wherein the guides comprise: outer peripheral faces of the curved parts.

* * * * *

UNITED STATES PATENT AND TRADEMARK OFFICE

CERTIFICATE OF CORRECTION

PATENT NO. : 6,609,922 B2
DATED : August 26, 2003
INVENTOR(S) : Chieko Torii

It is certified that error appears in the above-identified patent and that said Letters Patent is hereby corrected as shown below:

Column 9,
Line 22, delete second instance of "according to".

Signed and Sealed this

Thirteenth Day of April, 2004

JON W. DUDAS
*Acting Director of the United States Patent and Trademark Office*